US006896532B2

(12) United States Patent
Chang

(10) Patent No.: US 6,896,532 B2
(45) Date of Patent: May 24, 2005

(54) SWITCH TERMINAL FOR MEMORY CARD CONNECTORS

(75) Inventor: Chia-Chen Chang, Hsin Chung (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/869,544

(22) Filed: Jun. 16, 2004

(65) Prior Publication Data

US 2004/0259403 A1 Dec. 23, 2004

(30) Foreign Application Priority Data

Jun. 17, 2003 (TW) ..... 92211034 U

(51) Int. Cl.[7] ..... H01R 29/00
(52) U.S. Cl. ..... 439/188; 200/51.09
(58) Field of Search ..... 439/188, 630, 439/157–159, 862; 200/51.1, 51.09; 235/441, 492

(56) References Cited

U.S. PATENT DOCUMENTS 6,086,425 A * 7/2000 Lescoat ..... 439/630
6,129,571 A * 10/2000 Ikemoto ..... 439/260
6,326,568 B2 * 12/2001 Martucci et al. ..... 200/283
6,382,993 B1 * 5/2002 Chen ..... 439/157
6,399,906 B1 * 6/2002 Sato et al. ..... 200/61.59
6,485,319 B2 * 11/2002 Bricaud et al. ..... 439/188
6,719,577 B2 * 4/2004 Nogami ..... 439/188
6,719,589 B2 * 4/2004 Nishio et al. ..... 439/630
6,805,566 B2 * 10/2004 Chia-Chen ..... 439/188
2004/0266237 A1 * 12/2004 Kodera et al. ..... 439/159

* cited by examiner

*Primary Examiner*—Tho D. Ta
*Assistant Examiner*—Larisa Tsukerman
(74) *Attorney, Agent, or Firm*—Stacey E. Caldwell

(57) ABSTRACT

A memory card connector includes an insulative housing having a rear terminal-mounting section and at least one side wall section extending forwardly from one end of the rear section and defining a card-receiving space therebetween. First and second switch terminals are mounted on the housing and have first and second contact portions, respectively. A third switch terminal is mounted on the housing and has a pair of third contact portions engageable by the first and second contact portions of the first and second switch terminals, respectively, in response to inserting a memory card into the card-receiving space. The third switch terminal includes an elongated base having opposite ends, with at least the opposite ends of the base fixed to the housing. A pair of contact spring arms are cantilevered from the opposite ends of the base, whereby the opposite ends form a pair of fulcrums for flexing of the contact spring arms. Free ends of the arms form the third contact portions of the third switch terminal.

18 Claims, 6 Drawing Sheets

SWITCH TERMINAL FOR MEMORY CARD CONNECTORS

FIELD OF THE INVENTION

This invention generally relates to the art of electrical connectors and, particularly, to a memory card connector having an improved switch terminal.

BACKGROUND OF THE INVENTION

Memory cards are known in the art and contain intelligence in the form of a memory circuit or other electronic program. Some form of card reader reads the information or memory stored on the card. Such cards are used in many applications in today's electronic society, including video cameras, digital still cameras, smartphones, PDA's, music players, ATMs, cable television decoders, toys, games, PC adapters, multi-media cards and other electronic applications. Typically, a memory card includes a contact or terminal array for connection through a card connector to a card reader system and then to external equipment. The connector readily accommodates insertion and removal of the card to provide quick access to the information and program on the card. The card connector includes terminals for yieldingly engaging the contact array of the memory card.

The memory card connector often is mounted on a printed circuit board. The memory card, itself, writes or reads via the connector and can transmit between electrical appliances, such as a word processor, personal computer, personal data assistant or the like.

Some memory card connectors are provided with a write-protection function by means of a pair of elastic conductive terminals forming a controlling switch. The two switch terminals are mounted at a side of the connector and have respective elastic arms arranged in close proximity to each other and may be moved into mutual engagement by the memory card to close the controlling switch. Some memory card connectors are provided with a card detector function by means of a pair of elastic conductive terminals forming a detector switch. The detector switch typically is at a rear of the connector and is actuated by a leading edge of a memory card to "detect" that the card has been fully inserted into the connector. Some memory card connectors have both a write-protection function and a card detector function, with a common or "third" conductive terminal forming one of the switch terminals of both switches.

For instance, FIG. 1 shows a common or "third" terminal, generally designated 10, according to the prior art. The terminal has a main body, generally designated 12, including an elongated base 14 extending between a pair of upstanding arms 16 and 18. A pair of contact spring arms 18 and 20 extend in opposite directions from opposite sides of upstanding arm 16. A fixing tail 22 is spaced outwardly from upstanding arm 19 by means of a connecting arm 24, defining a mounting gap 26. Fixing tail 22 and mounting gap 26 may be provided for mounting terminal 10 on a connector housing.

In operation, contact spring arm 20 may comprise one of the switch contacts of a write-protection switch of the memory card connector, and contact spring arm 18 may comprise one of the switch contacts of a card detector switch of the connector. Both contact spring arms 18 and 20 flex or pivot about a single or common fulcrum provided by upstanding arm 16. This creates problems because the entire left-hand end of the terminal (as viewed in FIG. 1) deflects, twists and may deform because of the stress concentrations created by the single fulcrum 16 for both contact spring arms 18 and 20 operatively associated with both the write-protection switch and the card detector switch of the connector. In addition, the entire terminal is fixed at one far end thereof (the right-hand end as viewed in FIG. 1), and the terminal has a tendency to loosen and cause changes in position of the contact spring arms.

The present invention is directed to providing a new and improved switch terminal of the character described which solves the problems of the prior art including the problems outlined above.

SUMMARY OF THE INVENTION

An object, therefore, of the invention is to provide a new and improved switch terminal for a memory card connector.

In the exemplary embodiment of the invention, a memory card connector includes an insulative housing having a rear terminal-mounting section and at least one side wall section extending forwardly from one end of the rear section defining a card-receiving space therebetween. First and second switch terminals are mounted on the housing and have first and second contact portions, respectively. A third switch terminal is mounted on the housing and has a pair of third contact portions engageable by the first and second contact portions of the first and second switch terminals, respectively, in response to inserting a memory card into the card-receiving space. The third switch terminal includes an elongated base having opposite ends, with at least the opposite ends of the base fixed to the housing. A pair of contact spring arms are cantilevered from the opposite ends of the base, whereby the opposite ends form a pair of fulcrums for flexing of the contact spring arms. Free ends of the arms form the third contact portions of the third switch terminal.

According to one aspect of the invention, the third switch arm includes a pair of upstanding support arms projecting upwardly from the opposite ends of the base generally transversely of the elongated base. The contact spring arms are cantilevered from the upstanding support arms. The contact spring arms extend generally parallel to the elongated base and in the same direction away from the opposite ends of the base, whereby one of the contact spring arms generally overlies the elongated base.

As disclosed herein, the free ends of the contact spring arms of the third switch terminal comprise enlarged contact pads. The elongated base is generally planar and the contact spring arms are bent out of the plane of the base to position the third contact portions closer to the first and second contact portions of the first and second switch terminals, respectively.

According to another aspect of the invention, the insulative housing is adapted for mounting on a printed circuit board. The third switch terminal includes a tail portion for connection to an appropriate termination pad on the circuit board. The tail portion is spaced outwardly from one of the opposite ends of the base to define a gap therebetween. A connecting arm spans the gap and extends between the tail portion and the one opposite end of the base. The housing includes a mounting flange which projects into the gap of the third switch terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 1:
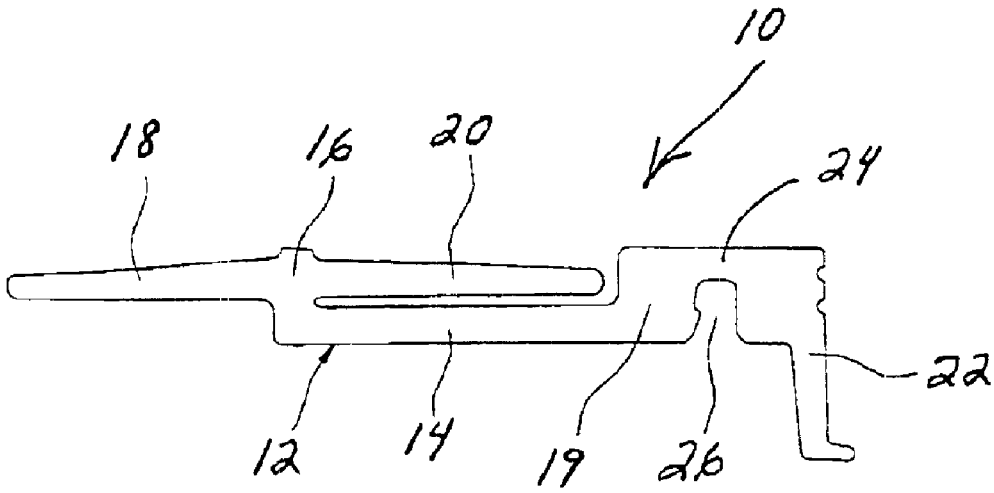
FIG 1 PRIOR ART
FIG. 1 is a side elevational view of a switch terminal according to the prior art and as described in the Background, above.
Figure 2:
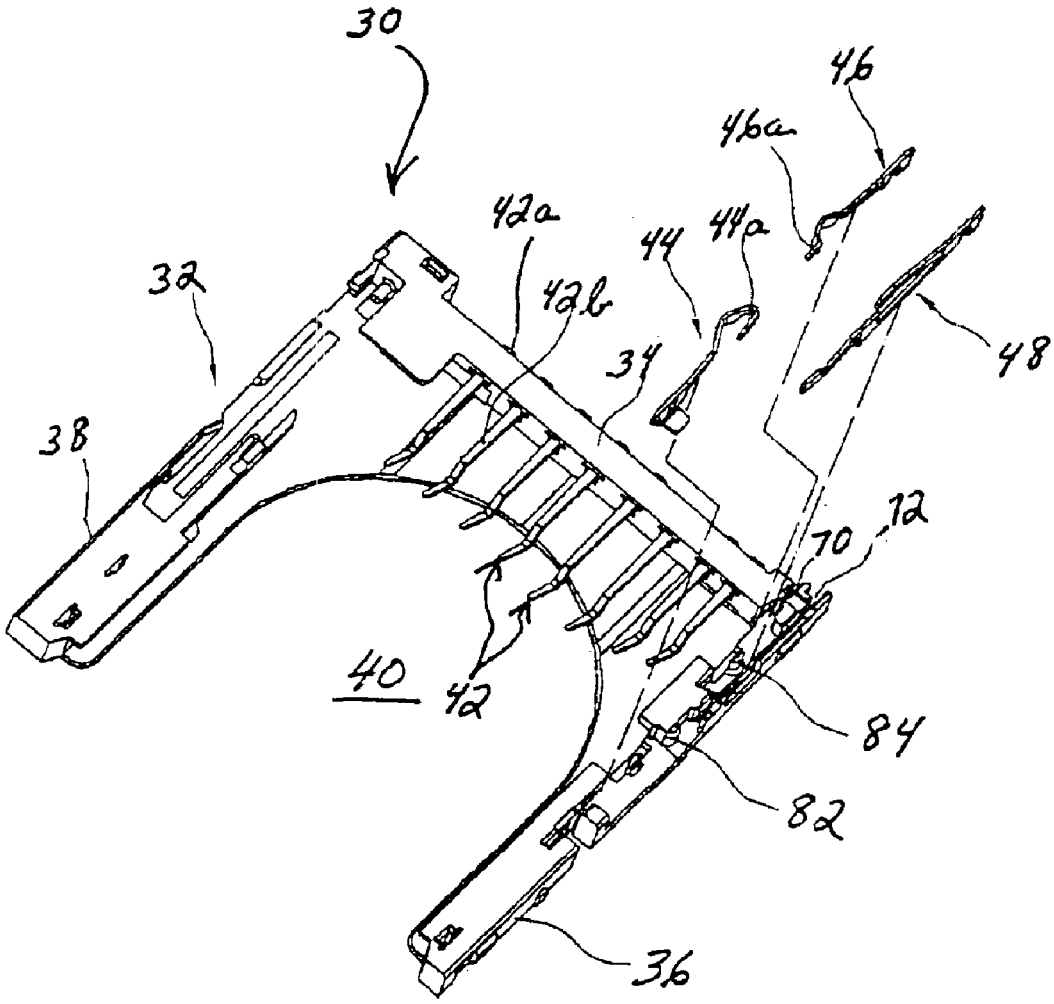
FIG. 2 is an exploded perspective view of a memory card connector, according to the invention.
Figure 3:
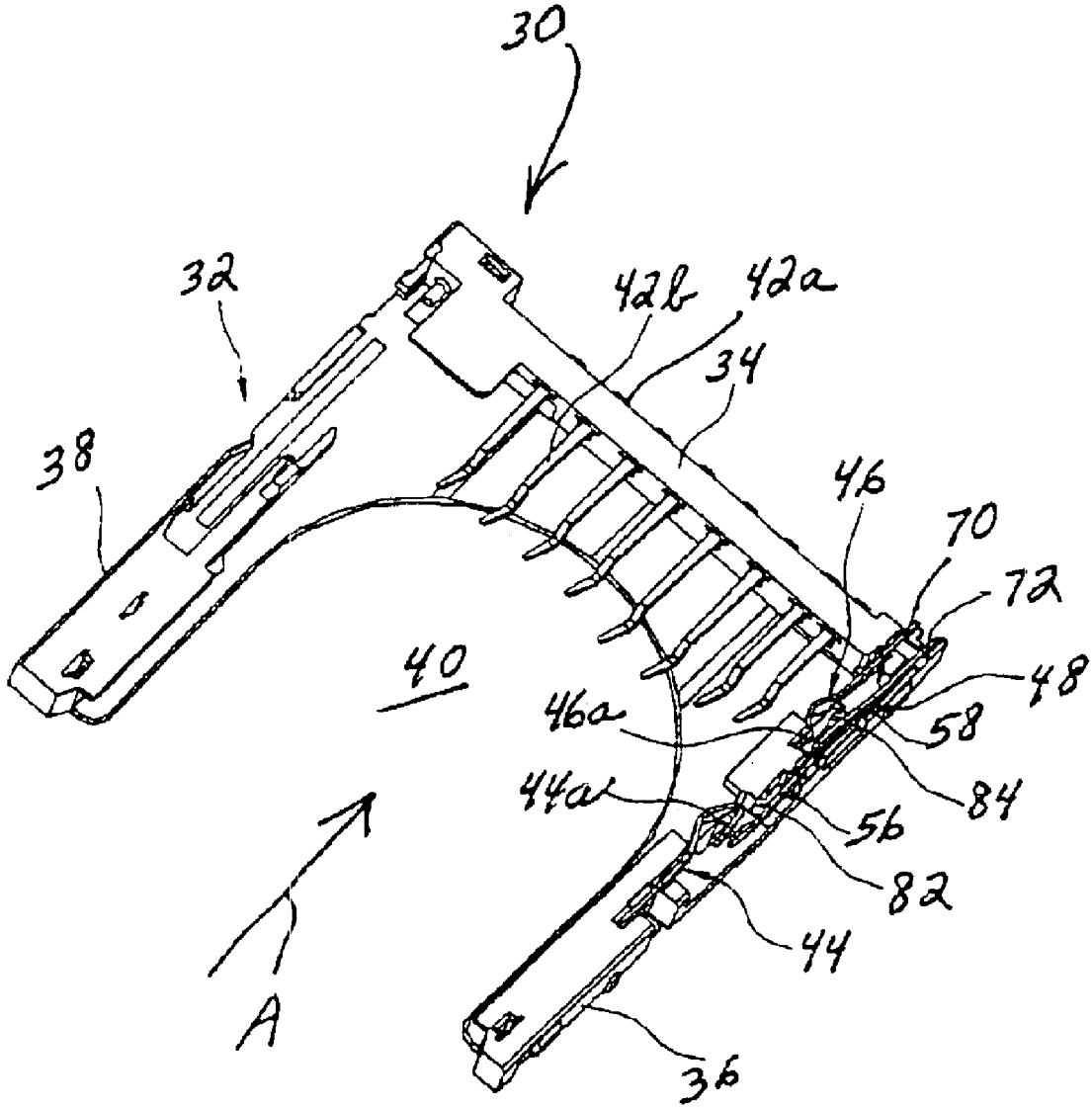
FIG. 3 is a perspective view of the connector of FIG. 2 in assembled condition.

Referring to the drawings in greater detail, and first to FIGS. 2 and 3, the invention is embodied in a memory card connector, generally designated 30, which includes an insulative housing, generally designated 32. The housing may be fabricated of insulating material such as molded plastic or the like. The molded plastic housing may be generally U-shaped (as shown) or L-shaped (not shown). In either event, the housing has a rear terminal-mounting section 34, along with a longitudinal side wall section 36 (and 38) which extends forwardly from one or both ends of the rear section to define a card-receiving space 40 therebetween.

A plurality of conductive terminals, generally designated 42, are mounted in rear terminal-mounting section 34 of the housing. Each terminal includes a tail portion 42*a* for connection, as by soldering, to appropriate circuit traces on a printed circuit board to which housing 32 is adapted for mounting. Terminals 42 also have contact portions 42*b* which extend forwardly into card-receiving space 40 for engaging appropriate contacts on a memory card inserted into the card-receiving space of the connector in the direction of arrow "A" (FIG. 3).

Connector 30 is provided with a write-protection function and includes a first (or write-protection) switch terminal, generally designated 44, having a first contact portion 44*a*. Connector 30 also is provided with a card detector function and includes a second (or card detecting) switch terminal, generally designated 46, having a second contact portion 46*a*. A common or third switch terminal, generally designated 48, is provided as a common terminal for effecting the write-protection function as well as the card detector function of the connector. In other words, third switch terminal 48 is operatively associated with first switch terminal 44 to form a write-protection switch therebetween, and third switch terminal 48 also is operatively associated with second switch terminal 46 to form a card detecting switch therebetween.

Figure 4:
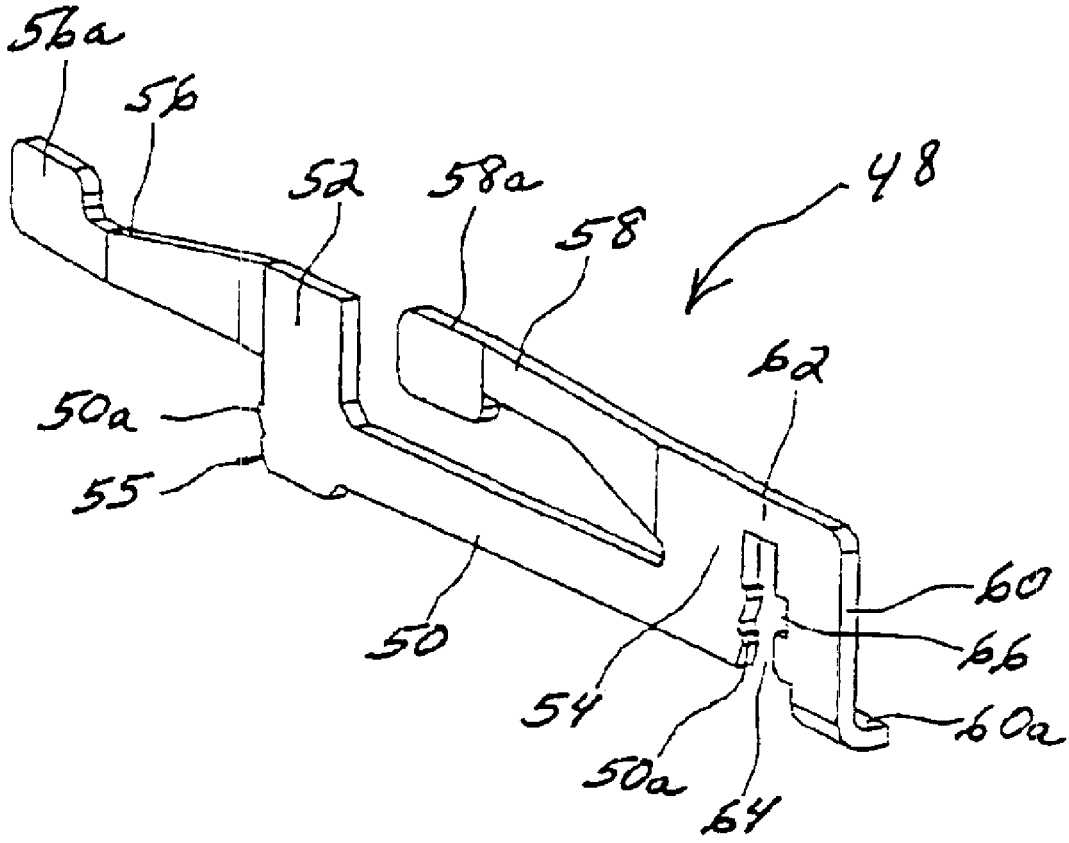
FIG. 4 is a perspective view of the improved switch terminal of the invention.

Referring to FIG. 4, third switch terminal 48 has an elongated base 50 having toothed opposite ends 50*a* which bite into the plastic material of the housing within an appropriate mounting slot therewithin to rigidly fix terminal 48 to the housing. Base 50 is generally planar and a pair of coplanar upstanding support arms 52 and 54 project upwardly from the opposite ends of the base to form a generally U-shaped structure. A pair of contact spring arms 56 and 58 are cantilevered from support arms 52 and 54 of the base in a direction generally parallel to the elongated base, as shown. Arm 48 extends generally over base 50. The free ends of contact spring arms 56 and 58 are formed with enlarged contact pads 56*a* and 58*a*, respectively. It can be seen that contact spring arms 56 and 58 are bent out of the plane of base 50 and upstanding support arms 54 to position contact pads 56*a* and 58*a* offset from the base. As will be seen, this positions the contact pads closer to the contact portions of first and second switch terminals 46 and 48, respectively.

Still referring to FIG. 4, third terminal 48 includes a tail portion 60 having a foot 60*a* for connection, as by soldering, to an appropriate termination pad on the printed circuit board. The tail portion is connected to upstanding arm 54 by a connecting arm 62 to define a gap 64 therebetween. A notch 66 is formed in one wall of the gap opposite the toothed end 50*a* of elongated base 50.

Figure 5:
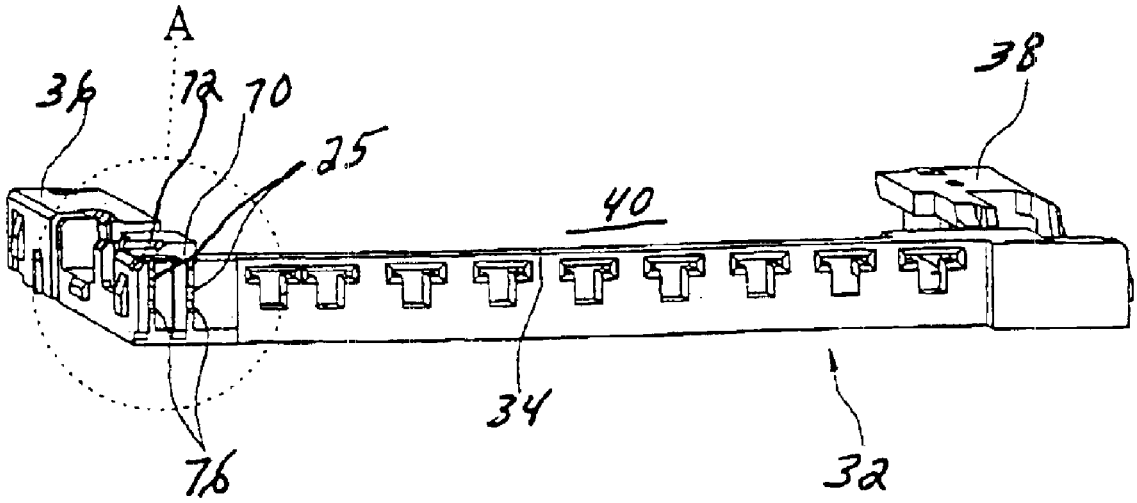
FIG. 5 is a rear perspective view of the insulative housing of the connector.
Figure 5A:
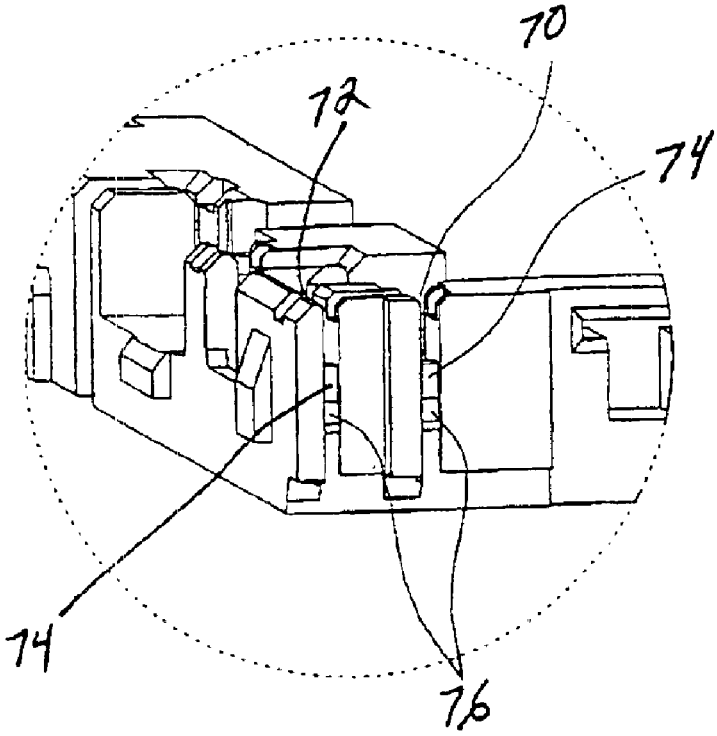
FIG. 5A is an enlarged, fragmented perspective view of the area encircled at "A" in FIG. 5.

Referring to FIGS. 5 and 5A in conjunction with FIG. 2, housing 32 has a slot 70 for mounting second switch terminal 46 therein, and a slot 72 for mounting third switch terminal 48 therein. As best seen in FIG. 5, each slot has a vertical wall 74 with an outwardly projecting protrusion 76.

Figure 6:
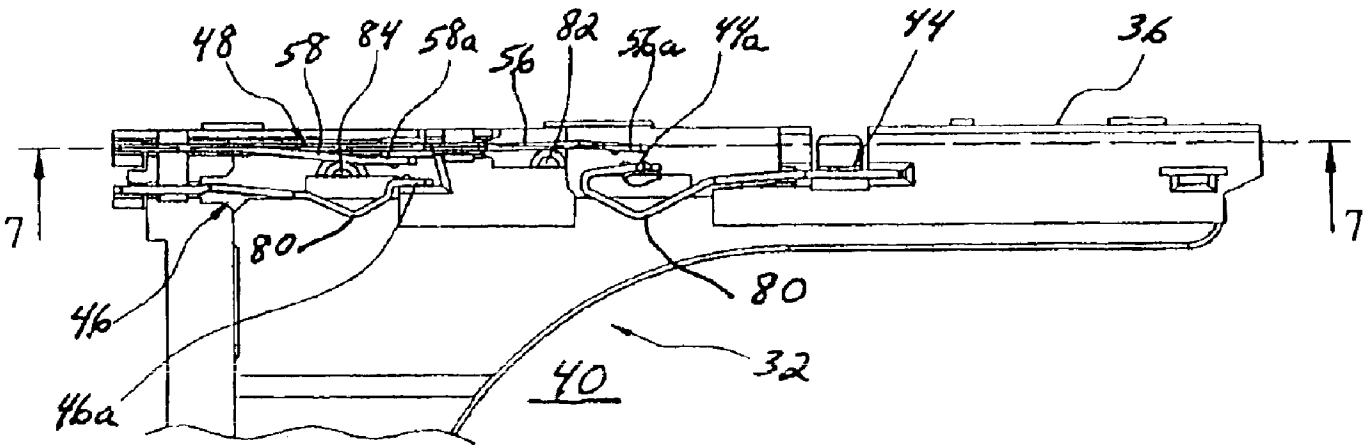
FIG. 6 is a fragmented, enlarged top plan view of the area of the connector where the switch terminals are located.

FIG. 6 shows first, second and third switch terminals 44, 46 and 48, respectively, mounted in housing 32. It can be seen that contact portion 44*a* of first switch terminal 44 is juxtaposed inwardly of contact portion 56*a* at the distal end of contact spring arm 56 of third terminal 48. Similarly, contact portion 46*a* of second switch terminal 46 is juxtaposed inwardly of contact portion 58*a* at the distal end of contact spring arm 58 of the third switch terminal. FIG. 6 also shows that each of the first and second switch terminals have inwardly bowed card-engaging portions 80 which project into card-receiving space 40.

Figure 7:
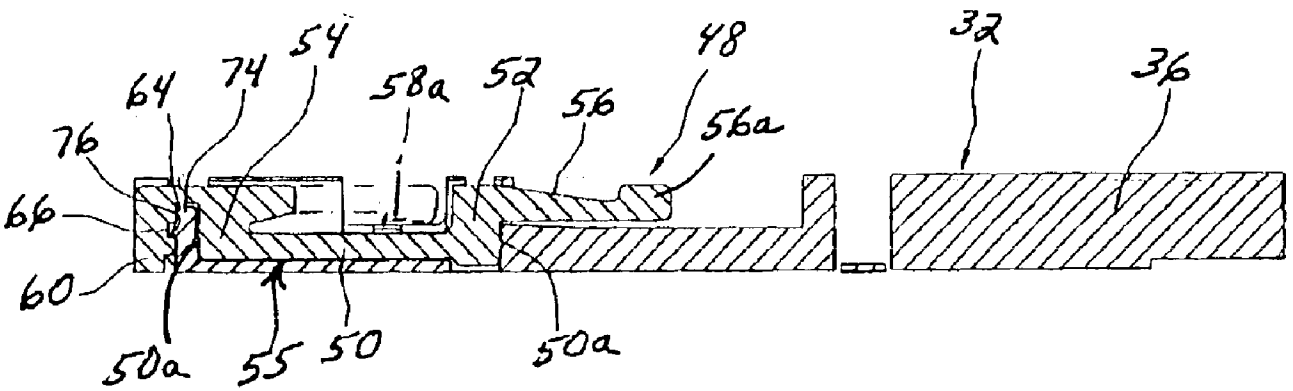
FIG. 7 is a vertical section taken generally along line 7—7 in FIG. 6.

FIG. 7 shows third switch terminal 48 mounted within slot 72 (FIG. 5A) of housing 32. It can be seen that the opposite toothed ends 50*a* of elongated base 50 are rigidly skived into the plastic material of the housing to rigidly fix upstanding walls 52 and 54 as fulcrums for contact spring arms 46 and 58, respectively. Vertical wall 74 within the mounting slot of the housing extends upwardly into gap 64 of the terminal, inside tail portion 60 of the terminal. Protrusion 76 (also see FIG. 5A) extends into notch 66 on the inside of tail portion 60 of the third terminal.

Finally, referring to FIG. 6 in conjunction with FIG. 2, the housing is provided with a pair of rounded positioning members 82 and 84 which engage the inside surfaces of contact spring arms 56 and 58, respectively. These positioning members precisely position contact pads 56*a* and 58*a* properly spaced from contact portions 44*a* and 46*a* of first and second switches 44 and 46, respectively.

In operation, when a memory card is inserted into connector 30 in the direction of arrow "A" (FIG. 3), the side edge of the card first engages the inwardly bowed card-engaging portion 80 of first switch terminal 44 as seen best in FIG. 6. The card, thereby, biases contact portion 44*a* of first switch terminal 44 into engagement with contact pad 56*a* at the distal end of contact spring arm 56 of the third terminal. This effects the write-protection function of the connector. Further movement of the memory card into the card receiving space causes the front edge of the card to engage the inwardly bowed card-engaging portion 80 of second switch terminal 46. The card, thereby, biases contact portion 46*a* of the second switch terminal into engagement with contact pad 58*a* at the distal end of contact spring arm 58 of the third terminal. This effects the card detector function of the connector to indicate that the card is in its fully inserted position.

From the foregoing, it can be seen that the common or third switch terminal 48 of the invention has two fixed fulcrums 52 and 54 from which contact spring arms 56 and 58 are cantilevered for independent flexing about their own independent fulcrum. This prevents twisting and deformation of the common terminal. Locating members 82 and 84 precisely locate contact pads 56*a* and 58*a* of the common terminal.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A memory card connector, comprising:

an insulative housing having a rear terminal-mounting section and at least one side wall section extending forwardly from one end of the rear section and defining a card-receiving space therebetween;

a first switch terminal mounted on the housing and having a first contact portion;

a second switch terminal mounted on the housing and having a second contact portion; and a third switch terminal on the housing and having a pair of third contact portions engageable by the first and second contact portions of the first and second switch terminals, respectively, in response to inserting a memory card into the card-receiving space, the third switch terminal including an elongated base having opposite ends, with at least the opposite ends of the base fixed to the housing, a pair of contact spring arms cantilevered from the opposite ends of the base whereby said opposite ends form a pair of fulcrums for flexing of the contact spring arms, and free ends of said contact spring arms forming said third contact portions.

2. The memory card connector of claim 1 wherein the free ends of said contact spring arms of the third switch terminal comprise enlarged contact pads.

3. The memory card connector of claim 1 wherein said elongated base of the third switch terminal is generally planar and the contact spring arms are bent out of the plane of the base to position the third contact portions closer to the first and second contact portions of the first and second switch terminals.

4. The memory card connector of claim 1 wherein said contact spring arms of the third switch terminal extend in the same direction away from the opposite ends of the base whereby one of the contact spring arms generally overlies the elongated base.

5. The memory card connector of claim 4 wherein said contact spring arms extend generally parallel to the elongated base.

6. The memory card connector of claim 1 wherein said third switch terminal includes a pair of upstanding support arms projecting from said opposite ends of the base generally transversely of the elongated base, and said contact spring arms are cantilevered from the upstanding support arms.

7. The memory card connector of claim 1 wherein said insulative housing is adapted for mounting on a printed circuit board, and the third switch terminal includes a tail portion for connection to an appropriate termination pad on the circuit board.

8. The memory card connector of claim 7 wherein said tail portion is spaced outwardly from one of said opposite ends of the base to define a gap therebetween.

9. The memory card connector of claim 8 wherein a connecting arm spans said gap and extends between the tail portion and the one opposite end of the base.

10. The memory card connector of claim 9 wherein said housing includes a mounting flange which projects into said gap of the third switch terminal.

11. A memory card connector, comprising:

an insulative housing having a rear terminal-mounting section and at least one side wall section extending forwardly from one end of the rear section and defining a card-receiving space therebetween;

a first switch terminal mounted on the housing and having a first contact portion;

a second switch terminal mounted on the housing and having a second contact portion; and a third switch terminal on the housing and having a pair of third contact portions engageable by the first and second contact portions of the first and second switch terminals, respectively, in response to inserting a memory card into the card-receiving space, the third switch terminal including an elongated generally planar base having opposite ends, with at least the opposite ends of the base fixed to the housing, a pair of upstanding support arms projecting from said opposite ends of the base generally transversely of the elongated base and coplanar therewith, a pair of contact spring arms cantilevered from the upstanding support arms generally parallel to the elongated base whereby said opposite ends of the base and the support arms form a pair of fulcrums for flexing of the contact spring arms, and free ends of said contact spring arms forming enlarged contact pads.

12. The memory card connector of claim 11 wherein said contact spring arms of the third switch terminal are bent out of the plane of the base to position the third contact portions closer to the first and second contact portions of the first and second switch terminals.

13. The memory card connector of claim 12 wherein said housing includes a pair of positioning members for engaging the pair of contact spring arms to properly position the enlarged contact pads on the arms relative to the contact portions of the first and second switch terminals.

14. The memory card connector of claim 11 wherein said insulative housing is adapted for mounting on a printed circuit board, and the third switch terminal includes a tail portion for connection to an appropriate termination pad on the circuit board.

15. The memory card connector of claim 14 wherein said tail portion is spaced outwardly from one of said opposite ends of the base to define a gap therebetween.

16. The memory card connector of claim 15 wherein a connecting arm spans said gap and extends between the tail portion and the one opposite end of the base.

17. The memory card connector of claim 16 wherein said housing includes a mounting flange which projects into said gap of the third switch terminal.

18. The memory card connector of claim 11 wherein one of said contact spring arms generally overlies the elongated base.

* * * * *